United States Patent [19]

Loveland

[11] 4,026,090

[45] May 31, 1977

[54] MEANS IN AUTOMATIC CARTON CLOSING MACHINES TO SUPPORT UNDERSIDES OF DOWN-FOLDED TOP SIDE FLAPS DURING ANCHORAGE OPERATIONS

[75] Inventor: Winton Loveland, Fort Salonga, N.Y.

[73] Assignee: The Loveshaw Corporation, Deer Park, N.Y.

[22] Filed: Feb. 6, 1976

[21] Appl. No.: 655,719

[52] U.S. Cl. ..... 53/374

[51] Int. Cl.[2] ..... B65B 7/20

[58] Field of Search ..... 53/374, 47

[56] References Cited

UNITED STATES PATENTS

| | | | |
|---|---|---|---|
| 3,191,353 | 6/1965 | Chidsey | 53/374 X |
| 3,377,767 | 4/1968 | Franz | 53/374 X |

*Primary Examiner*—Travis S. McGehee

*Attorney, Agent, or Firm*—Watson, Leavenworth, Kelton &Taggart

[57] ABSTRACT

In an automatic carton closing machine means to support temporarily from below down-folded lateral top side flaps of each carton as it travels through forward machine section and its folded top flaps are there being anchored. Raisable and lowerable elevating head carries downwardly infolding top flaps folding means to fold top end flaps inward toward each other with this head at the carton top and then top side flaps downward thereover as carton advances to pass through forward flap anchorage equipment with the forward head section carrying some of this anchorage equipment. Such head-supported anchorage equipment includes elongated, relatively stiff plate structure which extends laterally along the carton path approximately at the elevation of the carton top so that as such side flaps are folded down and inward above the infolded top end flaps they are lapped over this plate structure as supporting means therebelow while thereafter permitting the carton to advance with slide out of this plate structure. In some forms this plate structure may be in the shape of a two-tined fork with each tine located beneath one of the down-folded side flaps. Downward biasing of the down-folded side flaps against such plate structure or stabilizing their positions to a transverse plane at the top of the carton may be provided by any suitable means, e.g., weighting means and/or magnetic means which creates forces of attraction down toward the plate structure when the latter is of paramagnetic material. The shape of the plate structure is such as to avoid interfering with anchorage means and equipment for application thereof.

11 Claims, 5 Drawing Figures

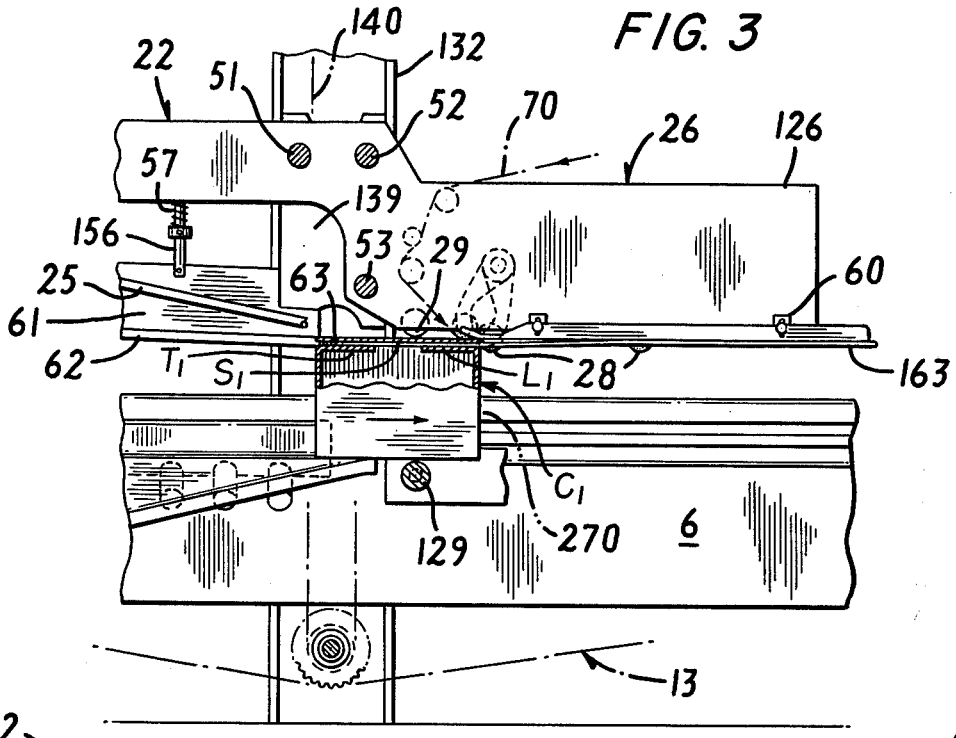
FIG. 3
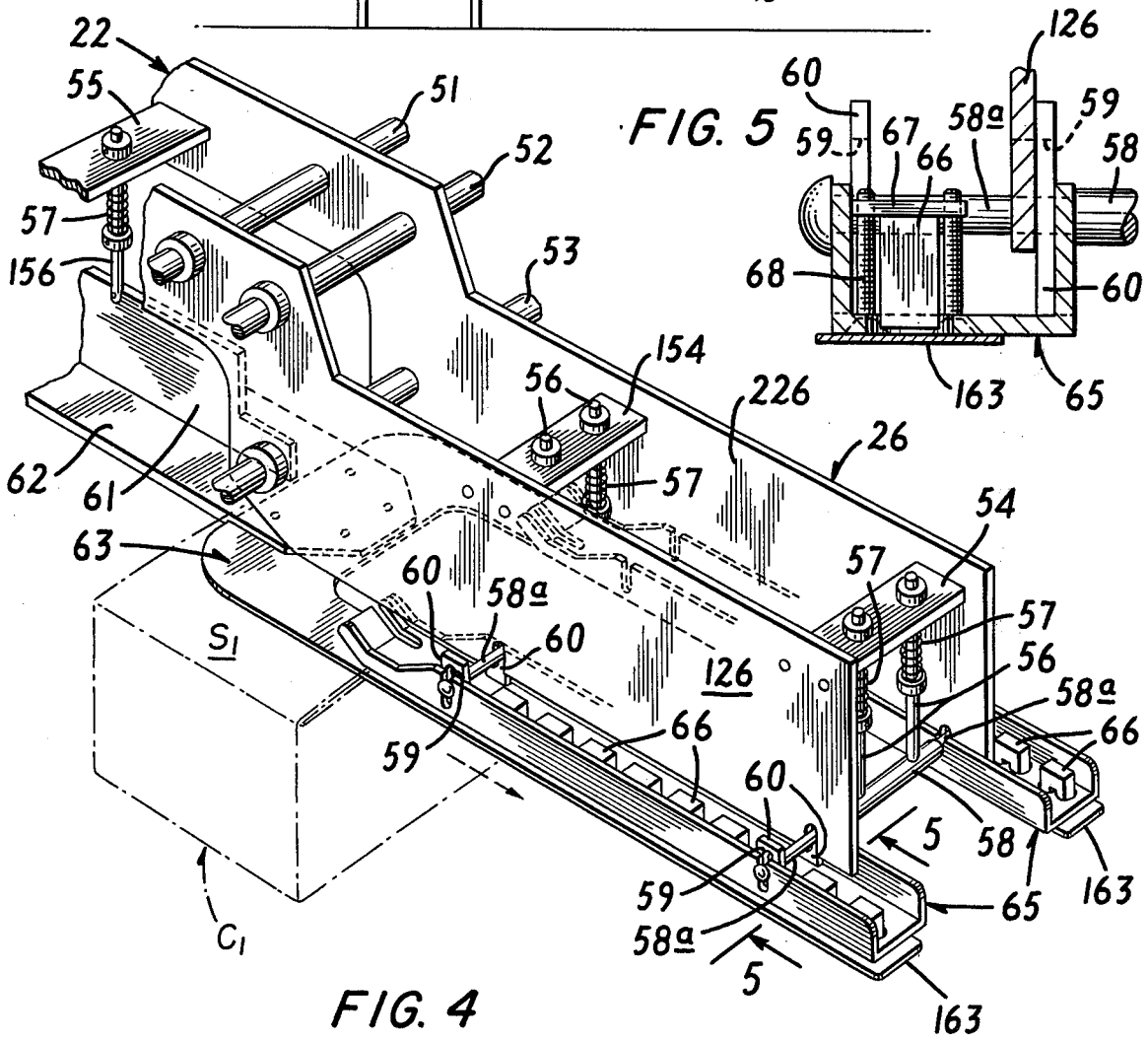
FIG. 4
FIG. 5

MEANS IN AUTOMATIC CARTON CLOSING MACHINES TO SUPPORT UNDERSIDES OF DOWN-FOLDED TOP SIDE FLAPS DURING ANCHORAGE OPERATIONS

BACKGROUND AND SUMMARY

The present invention is concerned with improvements of equipment of automatic carton closing machines carried by flap-folding and flap-anchoring elevating heads thereof, and of the general types as are illustrated in U.S. Pat. No. Re. 26,440 of Aug. 13, 1968 (and its parent U.S. Pat. No. 3,236,022) and No. 3,496,697 of Feb. 24, 1970. Such improved equipment here of concern, and variations thereof, provide supporting structure immediately beneath the carton top side flaps as the latter of any particular carton being processed through such machine are down-folded inward, with such supporting structure being withdrawable as each is advanced after flap anchoring equipment carried by the head has accomplished its intended purpose. The disclosures of the above-identified U.S. Pat. Nos. Re. 26,440 and 3,496,697 are embodied herein by reference.

It is an object of the present invention to provide in a relatively simple and economical manner such side flap supporting and biasing means on any such carton closing machine elevating head, that is reliable and does not interfere with the operation of flap anchoring equipment carried by such head while actually cooperating with the latter to assure production of efficient flap anchorages.

For such purpose the head-carried flap supporting and biasing means comprises elongated and relatively stiff plate structure that extends laterally along the path of cartons as they are processed through the machine. This plate structure is located by the head which carries it at an elevation above the carton path approximately that of the top of the sidewalls of the carton to be next transported along this path beneath the elevationally-adjustable head. Accordingly, as intended, this head infolds the upstanding leading front and trailing back end top flaps of any such certain carton and then overlays such infolded top end flaps with a relatively stiff foundation for the side top flaps next to be folded down thereover while avoiding extending transversely a distance greater than the widths of the infolded end flaps so as to prevent interfering with the infolding of such side flaps and the desired carton closing. Such supporting foundation for the infolded side flaps serves efficiently to support the latter as they are being anchored by the head-carried flap anchoring equipment while assuring avoidance of any tendency to crush-damage the carton top, particularly if the carton contents fails adequately to support the infolded closing flaps. This infolded side flaps supporting foundation structure extends laterally along a pair of appreciably laterally spaced longitudinal zones flanking opposite sides of a central longitudinal zone of appreciable width of the carton path with such central zone being available for placement and flaps anchorage action. Also, this flap supporting foundation means when of relatively flat and stiff sheet material slips easily from between the infolded top end flaps and the infolded top side flaps after is has served its desired purpose, merely by virtue of advance of the closed carton forward out of the machine.

In a preferred form such flaps-intervening plate structure is a fork having a pair of elongated, transversely-spaced and longitudinally-extending tines of substantially flat sheet material, each located in a path of forward travel of approximately the medial zone of one of the infolded side flaps whereby the transverse space intervening the tines is available for freedom of action therebetween of the flap anchorage equipment and, if desired, the placement there of the flap anchoring means. Desirably such tines may be of lengths appreciably greater than the longest cartons to be processed through the machine.

Another object is to provide such side flaps supporting and anchorage aiding equipment in forms which assure that the overlaying down-folded side flaps are biased firmly down to a lateral plane just above the down-folded end flaps for secure anchorage in such relative positions by the equipment-applied anchoring means. Such biasing means may be in the form of overlaying weighting means, or magnetic means cooperative with the supporting plate structure, or combinations thereof, as well as equivalents which apply the desired force upon the infolded side flaps to stabilize their positions to the transverse plane of the carton top. This is particularly important when the carton is not completely filled for service of the load as a support for the folded flaps at that plane. Otherwise, top-applying rollers will warp the top folded flaps down into the empty head spaces as such cartons are advanced through the flaps anchoring section, which may cause them to tear out the back end of the cartons in passing. In the use of magnetic biasing means the supporting plate structure, such as the fork tines, may be of paramagnetic material with the cooperating magnetic means being either permanent magnets or electromagnets. The attractive force therebetween does not prevent ready intervening insertion of carton flaps therebetween, and then withdrawal by normal carton advance. If desired, when electromagnets are employed their energizing circuits conveniently may be under the control of switch means associated with the machine power supply.

A further object of the invention is to provide, as convenient and economical means for supporting, in a simple manner the magnetic means on and below the head structure, one or more longitudinal shoes of diamagnetic material for arrangement of a plurality of units as the magnetic means in a single or plurality of longitudinal rows above one or more zones of the paramagnetic plate structure.

Other objects of the invention will in part be obvious and will in part appear from reference to the following detailed description taken in connection with the accompanying drawings, wherein like numerals identify similar parts throughout, and in which:

FIG. 3 is a side elevational view with parts broken away and others in section, of such portion of the machine of FIG. 1 as is concerned with the supporting of the undersides of down-folded top side flaps of a flap-closed carton therein shown, partly in section, as advancing through the flap anchorage equipment of the machine;

FIG. 4 is a detailed perspective view to larger scale of equipment shown in FIG. 3, with some parts in section and broken away and showing the advancing carton in broken lines, and FIG. 5 is an enlarged sectional view taken substantially on line 5—5 of FIG. 4, with parts broken away.

Figure 1:
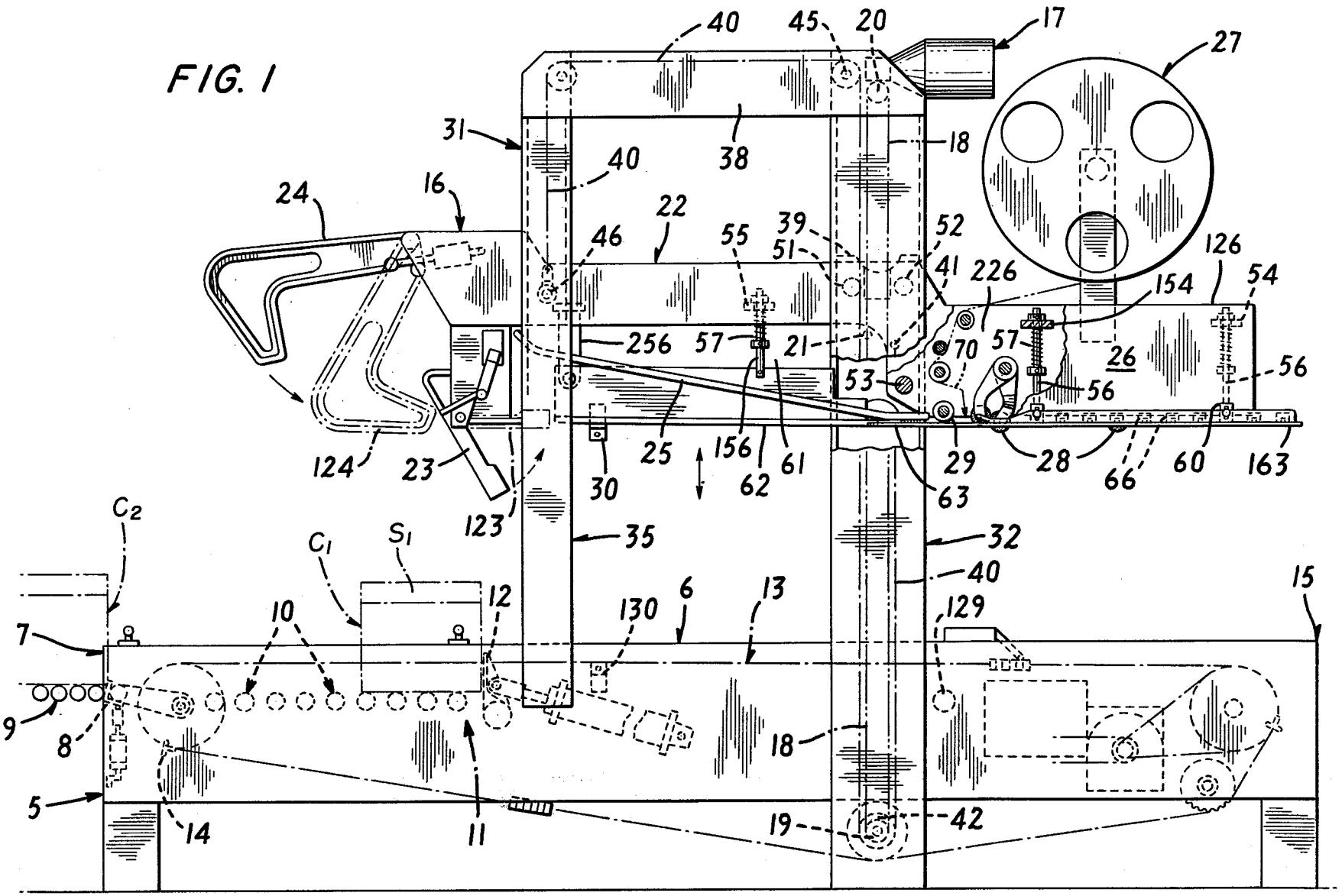
FIG. 1 is a side elevational view to reduced scale, with parts omitted for clarity and others broken away, of an automatic carton closing machine that embodies means of the present invention to support undersides of down-folded top side flaps of a flap-closed carton during operations of anchorage of the folded top flaps.

The embodiment of the automatic carton closing machine illustrated by way of example in the drawings comprises the following structure as is more fully explained in the applicant's copending U.S. patent application for "AUTOMATIC CARTON CLOSING MACHINE EQUIPPED WITH BALANCING TETHER SUSPENSIONS OF THE ELEVATING FLAP-FOLDING AND FLAP-ANCHORING HEAD", Ser. No. 607,093 filed Aug. 25, 1975. Bed unit 5, in the form of a lateral base structure, includes an elongated rectangular frame 6 which defines a longitudinal lateral path of travel for a series of successive cartons (C) which are preloaded with contents, and have their top flaps (and, if desired, their bottom closing flaps) unanchored for sealed closure thereof. This base frame 6 has an entrance end 7 periodically blocked by a retractable gate 8 at the delivery end of a feed conveyor 9 which supplies the loaded cartons successively forward onto a lateral lift having a horizontal series of rollers 10 for forward feed to a flap-folding station 11. A fluid-motor operated pivoted gate 12 normally bars the exit from the station 11 for temporary retention of each fed carton ($C_1$) thereat. In such stopped position each such loaded carton ($C_1$) is located between the side chains of an endless chain conveyor 13 which is temporarily stopped with a cross flight 14 located a distance back of the carton stopped at the flap-folding station 11 behind raised gate 12. When the latter is lowered, following flap-folding operations at this station on this carton, the latter is then transported forward by the endless chain conveyor 13 through equipment designed to anchor folded bottom and top flaps and finally out of the discharge or forward end 15 of the machine.

Each supplied carton ($C_1$) as it reaches the flap-folding station 11 has its top leading and trailing end flaps and both of its side flaps extending upwardly so that the carton top is open. A flap-folding head 16 is mounted above the flap-folding station 11 so that the open top carton stopped at the latter is located therebeneath for manipulative folding of the upstanding flaps thereby. This head 16 is in the form of an elevating structure which is lifted and lowered by suitable power driven means in properly timed relation by suitable control mechanism. Thus, before the following carton ($C_2$), which is checked in a stop position behind the entrance gate 8 is released by lowering of this gate, the flap-folding head 16 will have been suitably lifted high enough to permit this open top carton to be advanced freely to the flap-folding station 11 therebeneath. This lift of the elevating head is accomplished by operation of one of a number of different types of elevator power means well-known in the art, both by virtue of the disclosures of the previously identified prior U.S. Pat. Nos. 3,236,022 and 3,496,697, as well as many of such machines which have long been in commercial service. The latter include machines in which the elevating heads are lifted and lowered by double-ended hydraulic motors. For example, the type of reversing motor and endless chain drive illustrated in these prior art patents includes such motor as is diagrammatically indicated in FIG. 1 at 17 to rotate alternately in opposite directions and endless drive chain 18, or the like, with the runs thereof extending substantially vertically from a bottom sprocket 19 to top sprocket 20 about which it is lapped, and with this endless chain suitably anchored to the elevating head 16, such as at 21.

The elevating head 16 constitutes an elongated, generally lateral beam structure 22 on which is mounted the variety of types of flap-folding equipment and folded flap anchoring means. For example, such elevating head beam 22 may pivotally support a hanging arm 23 for folding down the leading upstanding end flap, a pivotable folding arm or "kicker" 24 for folding forward the trailing upstanding end flap and a pair of side plows 25 for folding down the upstanding side flaps; as well as support on its terminal section 26 of equipment for anchoring the folded top end flaps, such as a gummed tape supply reel 27, tape applying wipers 28, and one or more pressure rollers 29. The discharge end section of the base structure preferably will be equipped with similar flap anchoring mechanism to perform like anchorage of the bottom flaps. If such anchorage is to be accomplished by means of suitable adhesive to be interposed between opposing surfaces of folded flaps the elevating head beam will likewise carry suitable adhesive applying means (such as nozzle 30 and supply equipment therefor) and a plurality of sets of pressure rollers to hold the flaps securely in face-to-face contact while the adhesive sets. Shipping regulations for importing and exporting loaded closed cartons currently are requiring that they be provided with a pair of differing supplemental anchorages for the folded end flaps such as staples and gummed tape, or either one of these supplemented by the anchoring adhesive.

The elevating head 16 is advantageously suspended by flexible tethers 40 and 140 upon suitable tower structure 31, with the latter conveniently supported by the machine base 6. This tower structure 31 has a pair of upright support members 32 and 132, preferably in the form of relatively rigid and elongated channel members having their grooves 88 and 133 arranged in opposed relation with their bottom ends anchored to the machine base structure 6 and their top ends transversely tied together by cross brace 34. This tower structure includes a second pair of upright members 35 and 135 having their bottom ends anchored to the machine base structure 6 and with their top ends transversely tied together by another cross brace. The top ends of the upright channel members 32 and 132, and 35 and 135 are also longitudinally tied together on opposite sides of the machine base 6 by horizontal tower members 38 and 138. The elongated head frame or beam 22 is provided on opposite sides with slides 39 and 139 which are capable of slidably traveling up and down within the opposed channel grooves 33 and 133. On the near side of the machine as viewed in FIG. 1, and the right side of FIG. 2, it will be seen that flexible tether chain 40 is anchored at 41 to slide plate 39 which in turn glides up and down within the groove 33 of channel 32. This chain link flexible tether 40 ultimately extends down to anchorage to the same side of the elevating head 16 to 46 on a rearward section thereof appreciably spaced back from the slide 39. Such flexible link chain tether is substantially duplicated on the other side of tower 31.

Since the present invention is concerned with flap anchorage equipment on the forward or discharge end section 26 of the elevating head beam 22 an aid to an understanding of such equipment may begin with a recital of the progressive steps of operation of such a machine as a carton ($C_1$) is received upon the lift 10 to travel to the flap-folding station 11 to be held there in a stop position abutted against the raised gate 12. The automatic controls dictate the lowering operation of the powered mechanism which lifts and lowers the flap-folding head 16, so that the latter descends down toward the top of this stopped carton at the flap-folding station until the depending front flap-folding arm 23 engages the upstanding leading end flap ($L_1$) of the carton to cause the latter to swing backward and down upon the load within the carton, as this front flap-folding arm is swung to its broken line position at 123 (FIG. 1). This action also determines the elevation of the head 16 at which it is stopped to be there maintained during the remainder of the operation of the processing of the carton and its delivery from the machine. After so folding back and down the previously upstanding leading end flap ($L_1$) with swing upward of the folding arm 23 to its broken line position at 123 the stop gate 12 is swung back to drop down out of the path of this carton for freeing it and allowing the endless chain conveyor 13 to start up and move the carton forward by means of the conveyor flight 14. This first causes the cocked back flap kicker 24 to swing forward to its broken line position 124, so as to fold the upstanding trailing end flap ($T_1$) forward, and then, as the carton is moving farther forward, to allow the side plows 25 and 125 to turn the upstanding side flaps ($S_1$ and $S_2$) down inward toward each other, over the end folded leading and trailing end flaps. Side plow 125 (not shown) is an allochiral duplicate of that shown at 25, and is mounted on the far side of head 16.

The discharge or forward section 26 of the head beam 22 preferably is comprised of a pair of transversely-spaced, vertical plates 126 and 226 through which extend three transverse rods 51, 52, and 53 to form a relatively rigid frame structure and to fix thereto the slides 39 and 139. Vertical plates 126 and 226 are also tied transversely together by hanger straps 54, 154, and 55 through which are suspended, for up and down slidable motion, vertical headed pins 56 and 156 which are biased downwardly by compression springs 57. Vertical pins 56 which are suspended from transverse hanger strap 54 support at their lower ends a transverse support rod 58 which has, at its opposite ends, coaxial and smaller diameter headed end sections **58*a* that are slidably mounted, for up and down motion, in vertical slots 59 provided in supporting tabs 60. This downwardly-biased suspension structure is repeated at the transverse hanger strap 154.**

Figure 2:
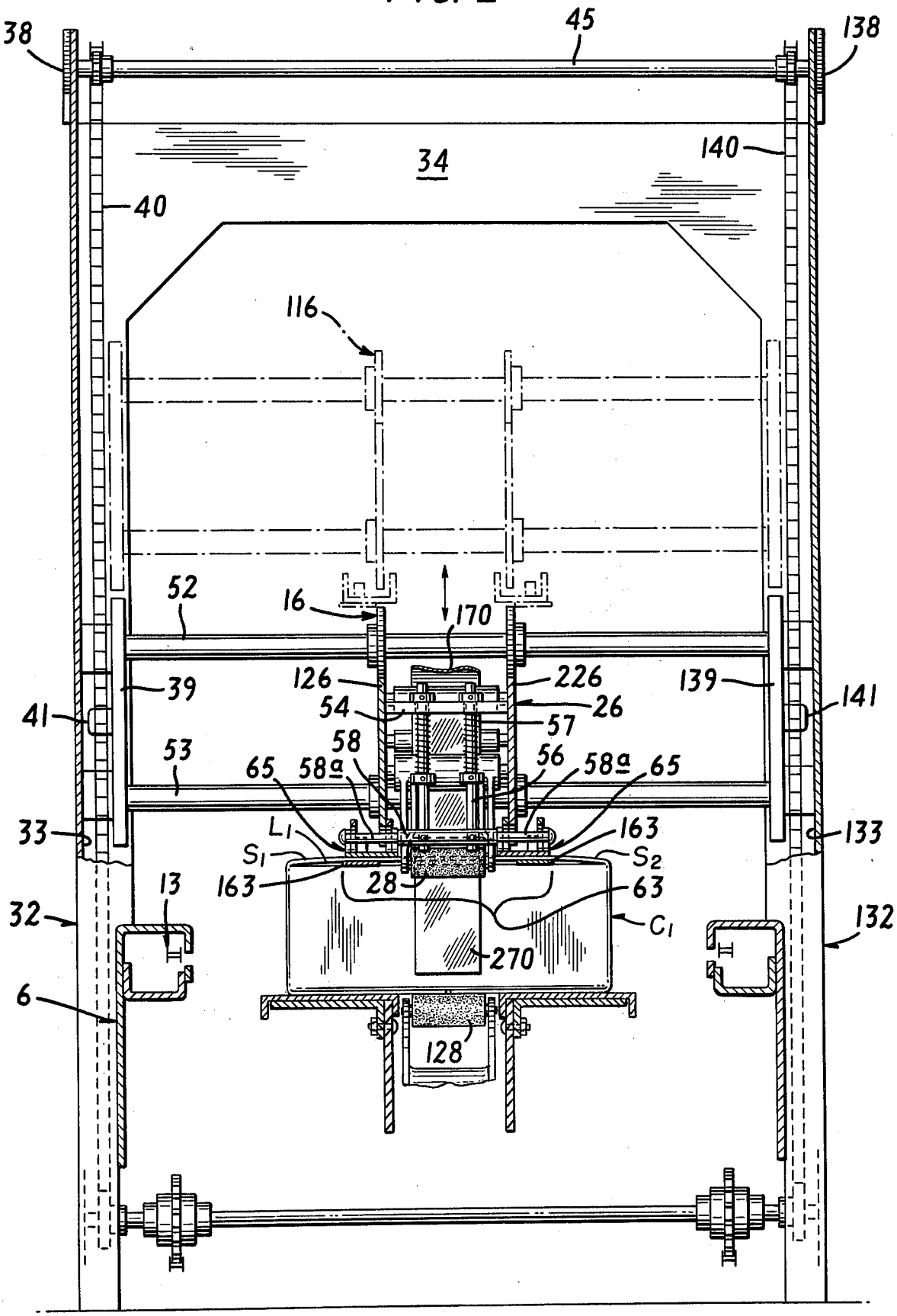
FIG. 2 is a forward or discharge end elevational view, with parts broken away and in section, of the machine of FIG. 1 and of some of its head equipment that is concerned with the present invention, showing in broken lines an upper position thereof and in full lines the lowered position thereof as determined by the lateral plane of the flap-closed top of a carton.

The downwardly-biased, vertical headed pin 156, which is suspended from the transverse hanger strap 55, supports one end of a substantially centrally located and longitudinally-extending suspension plate 61 with the back end of the latter also suitably supported in suspension by suitable means 256 (FIG. 1). The bottom edge of longitudinally-extending vertical support plate 61 is suitably anchored, such as by welding to a longitudinally-extending lateral support plate 62. To the forward end of plate 62 is mounted, for support thereby, side flap supporting means in the form of elongated, relatively stiff plate structure 63 which, as will be seen from FIGS. 2 and 4, is of an overall width no greater than the width of the leading front and trailing back end flaps of carton ($C_1$), i.e., its width 64. This side flap supporting plate structure 63, while being of an overall width less than the width of the carton, is preferably of appreciably greater length in the direction of the carton lateral path than the end-to-end length of any carton to be closed by the machine whereby a considerable extent of the plate structure length will extend forward of the leading end of the carton after the side flaps ($S_1$) and ($S_2$) are infolded down thereover by the side plows 25 and 125 for appreciable wipe of the infolded end flaps ($L_1$) and ($T_1$). Thus, in longitudinal advance along the carton travel path there is appreciable wipe of these infolded end flaps immediately therebeneath and, in turn, of these infolded side flaps immediately thereover for firm support of the latter while anchoring equipment on the elevating head 22 effects the secure anchorage of these infolded side flaps by the equipment supported on the forward head beam section 26.

Preferably, this plate structure 63 is in the form of a fork having a pair of elongated, transversely-spaced and longitudinally-extending tines 163. Such tines may, for example, be made of steel and of the order of about 1½ wide and only a few thousandths of an inch thick, such as about 0.015 inch. If desired, and in view of the preferred long lengths of such tines the latter may be provided with means to suitable stiffen them without appreciably increasing their thicknesses, such as by transversely concaving them to form top-side longitudinal channels which is known in some arts to prevent undue sagging of similar thin strips. In any event the tines 163 are substantially flat.

It can be appreciated that the advancing carton with its leading and trailing end flaps folded inwardly and down toward each other, as is illustrated in FIG. 3, will be traveling forward beneath the lateral and longitudinal plate 62 with the side plow rods 25 and 125 gradually turning the side flaps inwardly and down thereover so that, as the carton advances between the top and bottom pressure rollers 29 and 129 the tines will be slidably inserted between the infolded end flaps therebelow and the infolded side flaps thereabove, as is illustrated in FIG. 2. The relatively stiff plate structure tines 163 form firm supports for the infolded side flaps ($S_1$) and ($S_2$) without undue pressure being imposed upon the remaining portion of the top of the carton and particularly the infolded end flaps ($L_1$) and ($T_1$), so that if the carton contents does not reach to the top of the carton there will not be undue crushing pressure upon such carton top structure.

This novel feature of subtending support of the infolded side flaps also facilitates secure anchorage of the stacked closing flaps in completely and effectively carton closing positions since there is associated therewith means to bias these infolded side flaps downwardly firmly against the supporting plate structure tines while anchoring equipment is effecting the anchorage thereof. For example, weight loading structure may be floatingly supported or suspended from the bottom side of the head beam section 26 such as, e.g., a pair of longitudinally-extending and floatingly suspended, weighted shoes 65. In order that such means may provide a desired degree of biasing the supporting plate structure tines 163 may be formed of paramagnetic material (such as the sheet steel mentioned) and elongated shoes 65 may each respectively support therein a row of successive magnetic units 66, which may be in the form of permanent magnets. Such magnetic units may also be in the form of a plurality of successive electromagnets which are connected to an energizing circuit that may include a make-and-break switch associated with the master power switch of the machine, whereby when the electrical circuitry of the machine is turned on for a period of carton-closing operation these electromagnets will be energized and, upon deenergization of electrical circuitry, these electromagnets will also be de-energized.

Anchorage of such magnetic units 66 may, if desired, be in the form of a transverse hold-down strap 67, which may be provided as one of a number of such straps with each mounted above a single one of such magnets and suitably anchored to the shoe 65 such as by suitable screw means 68, (FIG. 5); or such anchoring strap means may be a continuous longitudinal plate or strap of diamagnetic material suitably clamped to the shoe which also preferably is of suitable diamagnetic material. Thus the elongated channel-spaced shoe 65 and such elongated anchoring strap may be formed of suitable, relatively-rigid, plastic, aluminum, brass, etc. It will be seen from FIGS. 2 and 4 that the pair of elongated, transversely-spaced and longitudinally-extending tines 163 of substantially flat and relatively thin paramagnetic material is located in a path of forward travel of approximately the medial zone of one of the infolded side flaps ($S_1$) or ($S_2$) with one of the rows of magnets 66 arranged in substantial parallelism thereabove.

With the use of such transversely-spaced shoes 65, as is illustrated in FIG. 4, an intervening transverse space of appreciable width is provided for freedom of action of the flap anchorage equipment. For example, let it be assumed, as is illustrated in the drawings, such flap anchorage equipment may include a supply of gummed tape carried by reel 27 and with the latter guided along a path 70 (FIG. 1) toward tape wipe-on equipment 28, so as to provide to the latter the gummed tape, a piece of which is illustrated at 170 in FIG. 2 for draping the end 270 against the advancing leading end of the carton and then up over the leading top end and back over the opposed free end edges of the side flaps ($S_1$) and ($S_2$). There is also shown therein at 128 one of the tape wipe-on rolls for cooperating with that at 28 for applying such tape. the intervening space between the plate structure tines 163 and the magnet-supporting shoes 65 provides such free space for the application of this anchorage tape and its applying equipment.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is the novel subjects matter defined in the following claims.

1. In an automatic carton closing machine for folding down and inward upwardly-extending top end flaps and opposed side flaps of cartons being transported longitudinally therethrough along a lateral path defined by a lateral machine base structure, the combination with a head for effecting the folding of such top flaps when in the vicinity of the top of such a carton and the latter passes forward along the carton lateral path with its opposite side flaps initially extending upwardly in unfolded positions, said head being elongated longitudinally in the direction of the carton lateral path with support thereby in longitudinal succession of both flap folding equipment and folded flap anchoring equipment, of 1. folded side flap supporting and biasing means carried by said head comprising elongated, relatively stiff plate structure extending laterally along a pair of appreciably laterally spaced longitudinal zones flanking opposite sides of a central longitudinal zone of appreciable width of the carton part at an elevation above the latter approximately that of the top of the sidewalls of a carton to be next transported along this path beneath said head with infolding by the latter of this carton's previously upstanding leading front and trailing back end flaps of certain width whereby these infolded end flaps travel immediately beneath such plate means which is of an overall width no greater than those folded end flaps,
2. means on said head to fold down and inward in opposite directions said upstanding side flaps over said elongated plate structure and the infolded end flaps immediately therebeneath with one of said folded side flaps lying above one of said flanking longitudianl zones and the other folded side flap lying above the other flanking longitudinal zone, and
3. folded flap anchoring equipment carried by said head forward of said flap folding means and in said central longitudinal zone of appreciable width with said side flap supporting plate structure extending forward along the path past said folded flap anchoring equipment whereby the infolded side flaps are supported thereby during anchoring of these side flaps.

2. The carton infolded top side flaps supporting and biasing means of claim 1 characterized by said plate structure being of appreciably greater length in the direction of the carton lateral path than the end-to-end length of any carton to be closed by said machine whereby a considerable extent of the plate structure length will extend forward of the leading end of the carton after the side flaps are infolded down thereover for appreciable wipe of the infolded end flaps immediately therebeneath and, in turn, of said infolded side flaps immediately thereover for firm support of the latter while anchoring equipment on said head effects the secure anchorage of the infolded side flaps.

3. The carton infolded top side flaps supporting and biasing means of claim 2 characterized by support on said head above said plate structure of means, forward along the travel path beyond said side flaps folding means, to bias said infolded side flaps downwardly firmly against said plate structure as the carton moves forward along the travel path and while the anchoring equipment is effecting the anchorage thereof.

4. The carton infolded top side flaps supporting and biasing means of claim 3 characterized by said plate structure being of paramagnetic material and said biasing means including magnetic means to cause said infolded side flaps to be pressed between said plate structure and said magnetic biasing means while allowing sliding therebetween for permitting advancing of the carton through the anchoring equipment.

5. The carton infolded top side flaps supporting and biasing means of claim 1 characterized by said plate structure being in the form of a fork having a pair of elongated, transversely-spaced and longitudinally-extending tines of substantially flat sheet material, each located in a path of forward travel of approximately the medial zone of one such infolded side flap whereby the transverse space intervening said tines is generally of the width of and aligned with the central longitudinal zone for mount of the flap anchorage equipment therebetween and freedom of action of the latter therein.

6. In an automatic carton closing machine for folding down and inward upwardly-extending top flaps of cartons being transported longitudinally therethrough along a lateral path defined by a lateral machine base structure, the combination with a head for effecting the folding of such top flaps when in the vicinity of the top of such a carton and the latter passes forward along the carton lateral path with its opposite side flaps initially extending upwardly in unfolded positions, said head being elongated longitudinally in the direction of the carton lateral path with support thereby in longitudinal succession of both flap folding equipment and folded flap anchoring equipment, of 1. side flap supporting and biasing means carried by said head comprising elongated, relatively stiff plate structure extending laterally along the carton path at an elevation above the latter approximately that of the top of the sidewalls of a carton to be next transported along this path beneath said head with infolding by the latter of this carton's previously upstanding leading front and trailing back end flaps of certain width whereby these infolded end flaps travel immediately beneath such plate means which is of an overall width no greater than those folded end flaps,
2. means on said head to fold down and inward in opposite directions said upstanding side flaps over said elongated plate structure and the infolded end flaps immediately therebeneath,
3. folded flap anchoring equipment carried by said head forward of said flap folding means with said side flap supporting plate structure extending forward between the underlying infolded end flaps and the infolded side flaps immediately thereabove along the path past said folded flap anchoring equipment whereby the infolded side flaps are supported thereby during anchoring of these side flaps, said plate structure being of a length appreciably greater than the end-to-end length of any carton to be closed by this machine,
4. said plate structure being of paramagnetic material and said biasing means including magnetic means to cause said infolded side flaps to be pressed firmly downwardly and between said plate structure and said magnetic biasing means while allowing sliding therebetween for permitting advancing of the carton through the anchoring equipment, and
5. said magnetic biasing means including at least one elongated row of a plurality of magnets suspended from said head substantially parallel to the travel path.

7. The carton infolded top side flaps supporting and biasing means of claim 6 characterized by said row of magnets being supported by a longitudinal shoe of diamagnetic material carried by said head.

8. The carton infolded top side flaps supporting and biasing means of claim 6 characterized by said magnetic biasing means including a pair of transversely spaced elongated rows of said magnets with each thereof being suspended above one of the side flaps with the transverse space intervening said rows being available for freedom of action of flap anchorage equipment therebetween.

9. The carton infolded top side flaps supporting and biasing means of claim 8 characterized by said rows of magnets being supported by a pair of transversely spaced such shoes with the intervening transverse space providing for the freedom of action of the anchorage equipment.

10. The carton infolded top side flaps supporting and biasing means of claim 8 characterized by said plate structure being in the form of a fork having a pair of elongated, transversely-spaced and longitudinally-extending tines of substantially flat and relatively thin paramagnetic material, each located in a path of forward travel of approximately the medial zone of one such infolded side flap with one of said rows of magnets arranged in substantial parallelism thereabove.

11. The carton infolded top side flaps supporting and biasing means of claim 10 characterized by each such fork tine being of relatively thin steel of the general order of a few thousandths of an inch thick with the magnetic fields of force of said rows of magnets assuring sufficient rigidity thereof to provide adequate support of the infolded side flaps.

* * * * *

UNITED STATES PATENT AND TRADEMARK OFFICE

CERTIFICATE OF CORRECTION

PATENT NO. : 4,026,090

DATED : May 31, 1977

INVENTOR(S) : Winton Loveland

It is certified that error appears in the above-identified patent and that said Letters Patent are hereby corrected as shown below:

Column 1, line 66, for "is" read --it--. Column 3, line 11, after "lines" a semi-colon (--;--) should replace the comma (","). Column 4, line 7, for "and" read --an--; line 68, for "to" read --at--. Column 6, line 28, for "1 1/2 wide" read --one and one half inches (1 1/2") wide--; line 31, for "suitable" read --suitably--. Column 7, line 49, for "the" (first occurrence) read --The--. Column 8, line 20, (claim 1, section 1.) for "part" read --path--; line 35 (claim 1, section 2.) for "longitudianl" read --longitudinal--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademark.*